US011369984B2

(12) United States Patent
Kitamura et al.

(10) Patent No.: US 11,369,984 B2
(45) Date of Patent: Jun. 28, 2022

(54) WASHING DEVICE AND OPERATION SETTING METHOD THEREFOR

(71) Applicant: SHIBUYA MACHINERY CO., LTD., Kanazawa (JP)

(72) Inventors: Takahito Kitamura, Kanazawa (JP); Shiaru Muranaka, Kanazawa (JP); Naoya Tsubota, Kanazawa (JP); Yuko Hasegawa, Kanazawa (JP)

(73) Assignee: SHIBUYA MACHINERY CO., LTD., Kanazawa (JP)

( * ) Notice: Subject to any disclaimer, the term of this patent is extended or adjusted under 35 U.S.C. 154(b) by 193 days.

(21) Appl. No.: 17/007,243

(22) Filed: Aug. 31, 2020

(65) Prior Publication Data

US 2021/0060597 A1 Mar. 4, 2021

(30) Foreign Application Priority Data

Sep. 2, 2019 (JP) ..... JP2019-159809

(51) Int. Cl.
*B05B 13/06* (2006.01)
*B05B 3/02* (2006.01)
*B08B 9/093* (2006.01)

(52) U.S. Cl.
CPC ..... *B05B 13/0636* (2013.01); *B05B 3/025* (2013.01); *B08B 9/0936* (2013.01)

(58) Field of Classification Search
CPC . B05B 3/025; B05B 13/0618; B05B 13/0636; B08B 9/0936
See application file for complete search history.

(56) References Cited

U.S. PATENT DOCUMENTS 6,039,056 A * 3/2000 Verbeek ..... B05B 3/02 134/167 R
7,300,000 B2 * 11/2007 Kitamura ..... B05B 7/0441 239/263.1
10,744,544 B2 * 8/2020 Kitamura ..... B08B 9/0936
2003/0116024 A1 * 6/2003 Francia ..... C12G 1/02 99/275
2015/0001310 A1 * 1/2015 Falster-Hansen ..... B01F 25/50 324/697
2019/0374984 A1 * 12/2019 Innes ..... B08B 9/0813

FOREIGN PATENT DOCUMENTS

JP 4636956 B2 1/2007
JP 201864912 A 4/2018
JP 2018171609 A 11/2018

* cited by examiner

*Primary Examiner* — Ryan A Reis
(74) *Attorney, Agent, or Firm* — Flynn Thiel, P.C.

(57) ABSTRACT

Parameters for a plurality of motors that move a nozzle on a three-dimensional movement locus are set easily. A washing device 1 includes display device 7, and a worker touches an input unit 7A of the display device 7 with a finger, to thereby set parameters for both servo motors that move a nozzle 3 on a three-dimensional movement locus. Specifically, a three-dimensional model Md1 of a tank 2 to be washed is displayed on the input unit 7A, and next, the worker drags specific spots of the three-dimensional model Md1, sequentially, and selects washing methods and washing time periods of the spots. The selected contents are transmitted to a control device 6, are computed by a computing unit 6A of the control device 6, so that the parameters for both servo motors for operating the nozzle 3 in three dimensions are set in washing.

4 Claims, 4 Drawing Sheets

WASHING DEVICE AND OPERATION SETTING METHOD THEREFOR

BACKGROUND OF THE INVENTION

Field of the Invention

The present invention relates to a washing device and an operation setting method therefor, and in more detail, to a washing device that causes a nozzle to operate in three dimensions to wash an inside of a tank, for example, and an operation setting method therefor.

Description of the Related Art

There has been conventionally known a washing device that causes a nozzle to enter an inside of a tank or the like as an object to be washed, to wash an inner surface of the object to be washed, and further known a washing device that causes a nozzle to eject a washing liquid to the entire inner surface of an object to be washed while causing the nozzle to operate in three dimensions, to wash the entire inner surface of the object to be washed (Japanese Patent No. 4636956).

In addition, as such a washing device, there is also proposed a washing device that includes two motors as drive means, so that a washing operation is arbitrarily controlled by individually controlling a rotation operation and a turning operation of the nozzle (Japanese Patent Laid-Open No. 2018-171609).

Incidentally, in the washing device disclosed in Japanese Patent Laid-Open No. 2018-171609 as described above, the washing operation of the nozzle is determined by parameters such as rotation speeds of the two motors. Therefore, in order to cause the nozzle to perform a required washing operation, it is necessary to set the parameters according to the washing operation in consideration of a shape of the object to be washed. However, it is difficult for general workers who are not familiar with a device configuration and programming to input these parameters and set the washing operation of the nozzle. In addition, even with workers familiar with such contents, a work of changing the setting of the parameters according to a shape and a state of stains of the object to be washed is complicated and increases a workload.

SUMMARY OF THE INVENTION

In view of the above-described circumstances, the present invention according to claim 1 provides a washing device including a rotating member that is provided in an axial rotatable manner, a turning member that is provided in a direction approximately perpendicular to the rotating member and provided in an axial rotatable manner, a washing liquid passage that is provided from the rotating member to the turning member, a nozzle that is provided to the turning member and ejects a washing liquid supplied through the washing liquid passage toward an object to be washed, a first servo motor that axially rotates the rotating member, a second servo motor that axially rotates the turning member, and a control device that controls operations of the first servo motor and the second servo motor, in which the nozzle ejects the washing liquid to the object to be washed, to wash the object to be washed, the washing device including display device that is capable of displaying a three-dimensional model corresponding to the object to be washed, wherein when a spot to be washed in the three-dimensional model displayed on the display device is selected, the control device sets parameters for the first servo motor and the second servo motor so that the washing liquid is ejected from the nozzle to a spot to be washed in the object to be washed corresponding to the selected spot to be washed in the three-dimensional model.

In addition, the present invention according to claim 4 provides an operation setting method for a washing device including a rotating member that is provided in an axial rotatable manner, a turning member that is provided in a direction approximately perpendicular to the rotating member and provided in an axial rotatable manner, a washing liquid passage that is provided from the rotating member to the turning member, a nozzle that is provided to the turning member and ejects a washing liquid supplied through the washing liquid passage toward an object to be washed, a first servo motor that axially rotates the rotating member, a second servo motor that axially rotates the turning member, and a control device that controls operations of the first servo motor and the second servo motor, in which the nozzle ejects the washing liquid to the object to be washed, to wash the object to be washed, the method including an input step of inputting information on a shape of the object to be washed by display device, a display step of displaying a three-dimensional model corresponding to the object to be washed, on the display device, a selection step of selecting a spot to be washed in the three-dimensional model displayed on the display device, and a setting step of setting parameters for the first servo motor and the second servo motor by the control device so that the nozzle ejects the washing liquid to a spot to be washed in the object to be washed corresponding to the selected spot to be washed.

According to such a configuration, the parameters for the first servo motor and the second servo motor can be easily set using the display device.

DETAILED DESCRIPTION OF THE PREFERRED EMBODIMENTS

Figure 1:
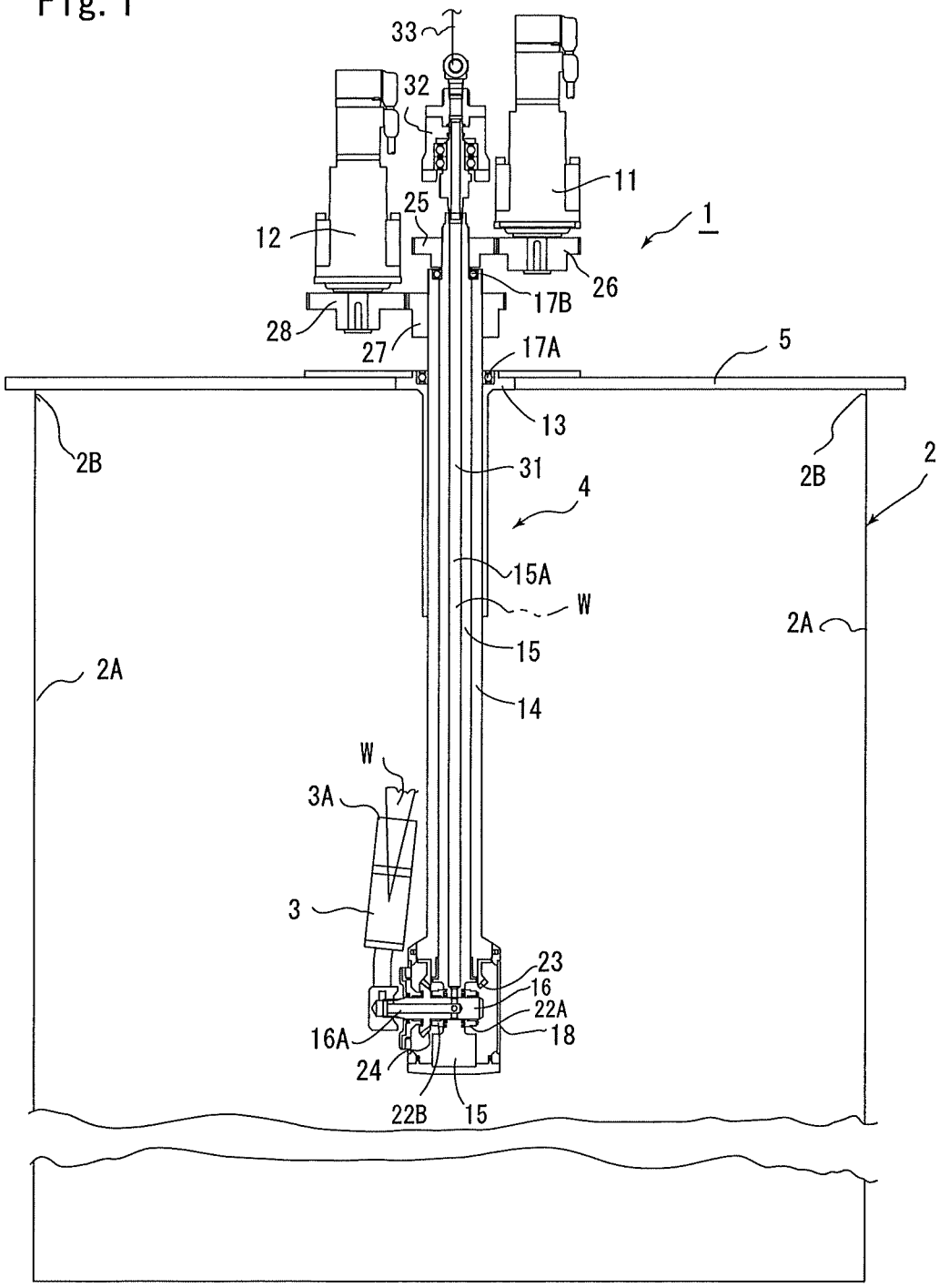
FIG. 1 is a vertical cross-sectional view illustrating one embodiment of the present invention.

Hereinafter, the present invention will be described by referring to an illustrated embodiment, in which in FIG. 1 and FIG. 2, reference numeral 1 denotes a washing device that washes a tank 2 as an object to be washed. The washing device 1 includes a washing unit 4 that ejects a washing liquid W from a nozzle 3 toward an inner surface 2A of the tank 2, a lid body 5 that has a center portion through which the washing unit 4 passes, and closes an opening portion 2B forming an upper end of the tank 2, an elevating and lowering mechanism (not illustrated) that elevates and lowers the washing unit 4 and the lid body 5, and a control device 6 that controls operations of the washing unit 4, the elevating and lowering mechanism, and the like.

The washing device 1 is adapted to cause the above-described elevating and lowering mechanism to elevate or lower the washing unit 4 and the lid body 5 so that the nozzle 3 of the above-described washing unit 4 is positioned inside the tank 2, and the opening portion 2B of the tank 2 is closed by the lid body 5, and to cause the nozzle 3 to eject the washing liquid W in the above-described state to wash the inner surface 2A of the tank 2. In this washing, the washing device 1 is adapted to move the above-described nozzle 3 on a three-dimensional movement locus, which enables the entire inner surface 2A of the tank 2 to be washed with the washing liquid W.

Although described in detail later, in the present embodiment, the control device 6 is adapted to control operations of a washing recipe created by combining a plurality of movement loci of the above-described nozzle 3, and the washing device 1 includes display device 7 comprised of a touch panel (a tablet PC) to set the washing recipe. After a three-dimensional model corresponding to the tank 2 to be washed is displayed on the display device 7, a worker at site operates the display device 7 by touching with a finger, to thereby be able to set parameters for controlling operations of a first servo motor 11 and a second servo motor 12 as drive sources of the nozzle 3.

As illustrated in FIG. 1, the washing unit 4 includes a tubular support member 13 that is elevated and lowered by the elevating and lower mechanism (not illustrated), an outer tube 14 that is pivotally supported by the support member 13 in a rotatable manner, an inner tube 15 as a rotating member that is pivotally supported on an inner side of the outer tube 14 in a rotatable manner, and a turning member 16 that is disposed on a lower end portion of the inner tube 15 in a horizontal direction and is pivotally supported in a rotatable manner, and the above-described nozzle 3 is coupled to a distal end portion of the above-described turning member 16. The above-described support member 13 is a tubular member, and is fixed to the above-described elevating and lowering mechanism in a vertical direction, and a center portion of the lid body 5 is coupled to the support member 13.

The outer tube 14 is pivotally supported inside the support member 13 through a bearing 17A, and is configured to be able to axially rotate in the horizontal direction in that state. In addition, the inner tube 15 is pivotally supported inside the outer tube 14 in a rotatable manner through a bearing 17B, and is configured to be able to axially rotate in the horizontal direction in that state.

A box-shaped gear case 18 is provided on a lower part of the outer tube 14 to be relatively rotatable in a circumferential direction with respect to the outer tube 14, and a distal end portion of the inner tube 15 protrudes into the gear case 18, and the above-described turning member 16 and the like are accommodated in the gear case 18.

A pair of bearings 22A and 22B are provided at a lower end portion of the inner tube 15 so that the above-described turning member 16 is pivotally supported by the pair of bearings 22A and 22B to be directed to the horizontal direction. With such a configuration, when the above-described first motor 11 is driven to rotate the inner tube 15, the turning member 16 can be turned in the horizontal direction around a rotation center of the inner tube 15.

An axis of the turning member 16 is adapted to be directed to the horizontal, whereby the turning member 16 is adapted to be able to rotate in a direction perpendicular to the rotating directions of the outer tube 14 and the inner tube 15.

A distal end of the turning member 16 protrudes to an outside of the gear case 18 in a state where liquid tightness is maintained, and a base portion of the nozzle 3 is coupled to the distal end portion in the direction perpendicular to each other.

The nozzle 3 is a flat nozzle ejecting the washing liquid W widely, and having an ejection port 3A which is a distal end of the nozzle 3 with an elongated linear shape, and is provided such that a longitudinal direction of the ejection port 3A is slightly inclined (by approximately 6 degrees in the present embodiment) with respect to the vertical direction so as to be able to wash a center portion of a bottom surface of the tank 2.

According to the above-described configuration, the nozzle 3 of the present embodiment is adapted to rotate in a horizontal plane around the inner tube 15 as the above-described rotating member, and rotate in a substantially vertical plane around the above-described turning member 16. In the following description, the revolution of the above-described nozzle 3 refers to rotation of the nozzle 3 in the horizontal plane around a rotation center of the inner tube 15 with the rotation of the inner tube 15, and the rotation of the above-described nozzle 3 refers to rotation of the nozzle 3 in the vertical plane around the rotation center of the above-described turning member 16 with the rotation of the turning member 16.

In addition, the nozzle 3 may be provided such that a longitudinal direction of the ejection port 3A is inclined by approximately 45° with respect to the axis of the turning member 16. This enables the washing liquid W to be ejected widely in any one of the case where the nozzle 3 is rotated without being revolved, the case where the nozzle 3 is rotated while being revolved, and the case where the nozzle 3 is revolved without being rotated.

Subsequently, inside the above-described gear case 18, a first bevel gear 23 as a sun gear is provided on a lower end portion of the above-described outer tube 14, and a second bevel gear 24 meshed with the above-described first bevel gear 23 is provided on an outer peripheral portion of the above-described turning member 16.

Moreover, an upper end portion of the above-described inner tube 15 protrudes above the above-described outer tube 14, and a gear 25 is provided on the protruding portion. And the first servo motor 11 including a gear 26 meshed with the above-described gear 25 is provided on a bracket (not illustrated) on the above-described support member 13.

Furthermore, a gear 27 is mounted on a portion protruding above the support member 13 in the outer tube 14, and the second servo motor 12 including a gear 28 meshed with the above-described gear 27 is provided on the bracket (not illustrated) on the above-described support member 13.

In the above-described configuration, when only the first servo motor 11 is driven by the above-described control device 6 and the second servo motor 12 is not allowed to be driven, only the above-described inner tube 15 is axially rotated through the gears 25 and 26, and the above-described outer tube 14 is not axially rotated.

At this time, since the above-described turning member 16 is pivotally supported at the distal end of the above-described inner tube 15 through the above-described bearings 22A and 22B, the turning member 16 is turned in the horizontal direction with the rotation of the above-described inner tube 15, and as a result, the above-described nozzle 3 is rotated in the revolving direction.

Moreover, the turning member 16 is rotated in the vertical direction with the rotation of the above-described inner tube 15 by meshing between the above-described first bevel gear 23 and second bevel gear 24, the above-described nozzle 3 is rotated in the rotating direction.

On the other hand, when the first servo motor 11 is not driven by the control device 6 and only the servo motor 12 is driven, only the outer tube 14 is axially rotated through the gears 27 and 28, and the inner tube 15 is not axially rotated.

As a result, since the inner tube 15 is not rotated, the turning member 16 is not turned in the horizontal plane and thus, the nozzle 3 is not rotated in the revolving direction. On the other hand, since the turning member 16 is rotated in the vertical direction by the meshing between the first bevel gear 23 of the outer tube 14 and the second bevel gear 24 of the turning member 16, the above-described nozzle 3 is rotated in the rotating direction.

In the present embodiment, the revolution and the rotation of the nozzle 3 by the first servo motor 11 are combined with the rotation of the nozzle 3 by the second servo motor 12 by individually controlling the above-described first servo motor 11 and second servo motor 12 by the control device 6, so that the nozzle 3 can be directed to an arbitrary direction.

More specifically, the nozzle 3 can be revolved while the rotation is stopped in a state where the nozzle 3 is inclined at a predetermined angle. For that purpose, after the nozzle 3 is rotated by the first servo motor 11 or the second servo motor 12 and is inclined at the predetermined angle, the inner tube 15 is operated at a required rotation speed by the above-described first servo motor 11 so as to revolve the nozzle 3 at the distal end of the turning member 16, while the rotation of the turning member 16 for rotating the nozzle 3 is offset by operating the outer tube 14 at a required rotation speed by the second servo motor 12 so as to stop the rotation of the nozzle 3. That is, by setting the rotation speeds and the rotation amounts of the first servo motor 11 and the second servo motor 12 in advance, a three-dimensional movement locus of the nozzle 3 when the washing liquid is ejected from the nozzle 3 to wash the inner surface 2A of the tank 2 can be arbitrarily set, and the movement locus on which the nozzle 3 is made to swing in the rotating direction by a predetermined angle each while the nozzle 3 is rotated in the revolving direction can be also obtained, for example.

A washing liquid passage 31 for supplying the washing liquid W to the nozzle 3 is provided from the above-described inner tube 15 to the turning member 16. The washing liquid passage 31 includes a liquid passage 15A formed inside the inner tube 15, and a liquid passage 16A formed in the turning member 16, and a supply source (not illustrated) for the washing liquid W is connected to a connection tool 32 provided on an upper end of the above-described liquid passage 15A through a conduit 33. An operation of the supply source for the washing liquid is controlled by the control device 6, and the control device 6 allows the washing liquid W to be supplied from the supply source for the washing liquid W to the washing liquid passage 31 through the conduit 33 when necessary. At this time, the washing liquid W is ejected from the nozzle 3.

In the washing device 1 of the present embodiment, the three-dimensional movement locus of the nozzle 3 can be arbitrarily set by controlling the rotation speeds of the first servo motor 11 and the second servo motor 12 by the control device 6, and, a movement locus of the nozzle 3 can be set to image such a washing locus that a specific spot where stains can remain easily on the inner surface 2A of the tank 2 is washed with emphasis, for example. Note that a basic configuration of the washing device 1 is known in, for example, Japanese Laid-Open Patent Application No. 2018-64912 and the like.

Incidentally, the three-dimensional movement locus of the above-described nozzle 3 is determined by the rotation speeds and the like of the first servo motor 11 and the second servo motor 12, but it is not easy for the worker at site to set such parameters to image an arbitrary washing locus, and to change the contents after the setting.

Then, in the present embodiment, the display device 7 comprised of a touch panel (a tablet PC) is added to the configuration of the above-described washing device 1. The worker at site operates the display device 7 by touching with a finger, to thereby be able to set parameters such as rotation speeds and rotation amounts of the first servo motor 11 and the second servo motor 12 without performing a complex computation operation. This enables the worker at site to visually check the contents displayed on the display device 7 and operate the display device 7 by touching with a finger to thereby set the parameters easily.

Figure 2:
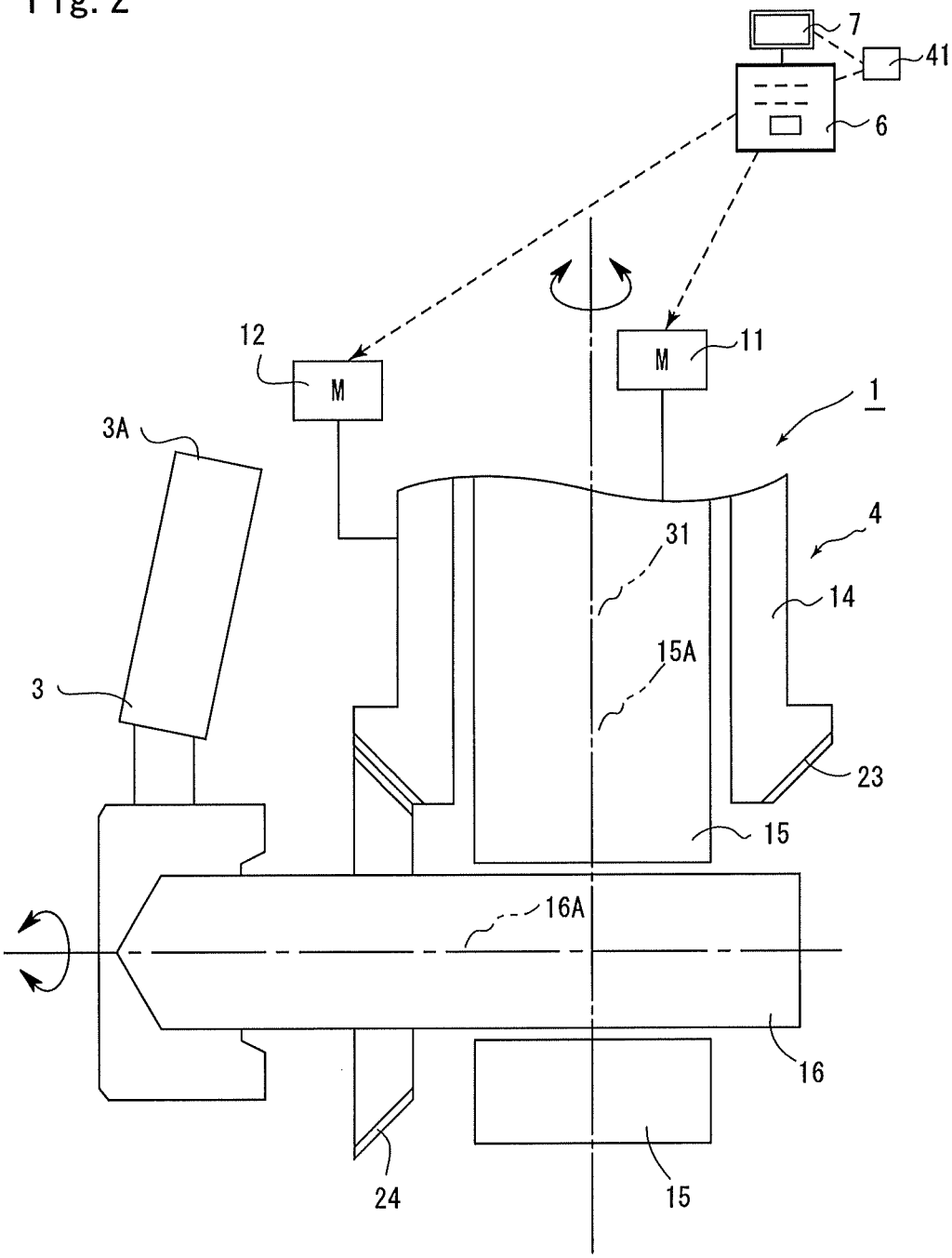
FIG. 2 is an enlarged view illustrating a schematic configuration of a principal part of FIG. 1.
Figure 3:
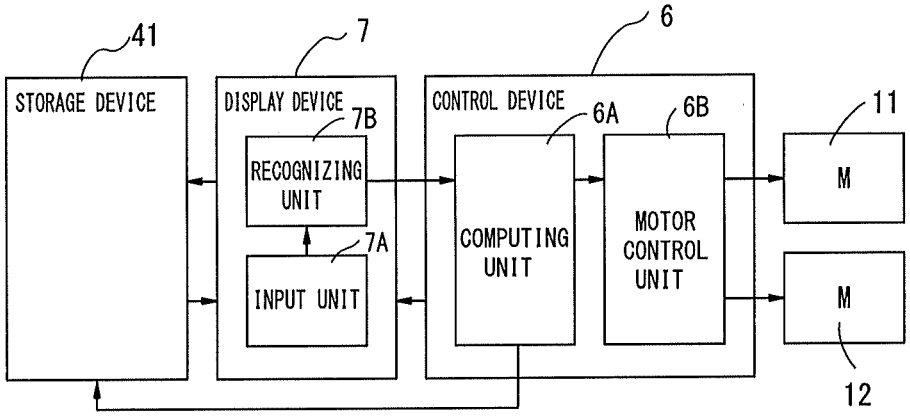
FIG. 3 is a configuration diagram illustrating a relationship among a control device, a display device and the like of FIG. 2.

That is, as illustrated in FIG. 2 and FIG. 3, the washing device 1 of the present embodiment includes the display device 7 comprised of a touch panel (a tablet PC), and the display device 7 is wiredly or wirelessly connected to the control device 6.

The control device 6 includes a motor control unit 6B that controls operations of the above-described both servo motors 11 and 12, and a computing unit 6A that performs required computation and computes the parameters for both of the servo motors 11 and 12. The three-dimensional movement locus of the above-described nozzle 3 can be obtained by controlling the rotation speeds and the rotation amounts of both of the servo motors 11 and 12 by the motor control unit 6B.

The computing unit 6A is adapted to perform the required computation and set the parameters for both of the servo motors 11 and 12 based on the pre-registered information on the washing device 1 including the number of gear teeth of the first bevel gear 23 and the second bevel gear 24 and positional information of the nozzle 3, and the information input on the display device 7, and to transmit the contents of the set parameters to storage device 41 which is separate from the control device 6.

The storage device 41 is adapted to register and store therein the parameters transmitted from the computing unit 6A. The storage device 41 pre-stores therein the information about shapes and types of various tanks 2 to be washed including three-dimensional models (a cylindrical shape, a square columnar shape, and the like) corresponding to such tanks 2.

The display device 7 includes an input unit 7A as a display screen which the worker can operate by touching with a finger to input the required information, and a recognizing unit 7B that recognizes the information input to the input unit 7A and transmits it to the computing unit 6A of the control device 6. The input unit 7A is adapted to be able to display a three-dimensional model corresponding to the tank 2 as an object to be washed and a spot to be washed in the three-dimensional model. In addition, the display device 7 is adapted to be able to receive and transmit the information from and to the above-described storage device 41.

In the present embodiment, in the stage before the tank 2 is actually washed by the washing device 1, the worker preliminarily operates the display device 7 so as to create washing recipes corresponding to a plurality of types of tanks 2 to be washed and register the washing recipes with the storage device 41. When the worker operates the display device 7 as follows, the parameters relating to the rotation speeds, the rotation amounts, and the like of both of the servo motors 11 and 12 are set.

That is, first, the shape of the tank 2 to be washed is specified. In the case of the tank 2 having a square columnar shape, for example, the worker touches the input unit 7A (display screen) of the display device 7 with a finger, and selects the shape corresponding to the tank 2 to be washed having the square columnar shape (see S1 in FIG. 4).

Figure 4:
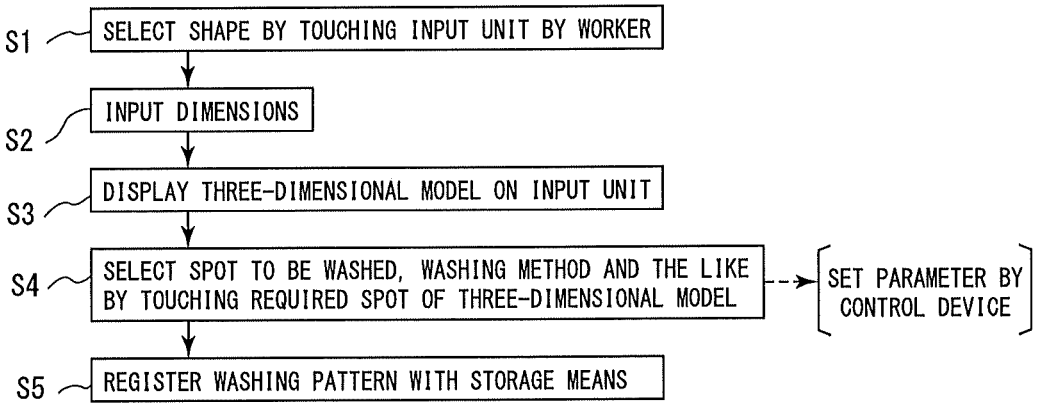
FIG. 4 is a flowchart illustrating steps of setting parameters using the display device and the like of FIG. 3.

Next, the worker touches the display screen as the input unit 7A, and inputs dimensions (vertical and horizontal lengths, height and depth, and the like) of each portion in the above-described selected shape (see S2 in FIG. 4). These dimensions are input in a state where a numeric keypad or the like is displayed on the input unit 7A.

Then, a three-dimensional model Md1 having a square columnar shape is displayed on the display screen as the input unit 7A, and the information indicating that the three-dimensional model Md1 is selected is transmitted to the recognizing unit 7B. (see S3 in FIG. 4, and FIG. 5).

Next, an object actually to be washed is the entire inner surface 2A of the tank 2, but the washing method can vary for each portion according to the state of stains or the like of each portion of the inner surface 2A of the tank 2. Then, in the present embodiment, the worker touches a required spot (an upper side, a lower side, a corner, a face, or the like) of the three-dimensional model Md1 displayed on the input unit 7A with a finger, and performs the following operations for selection of a spot to be washed in a special washing method, a washing method of the spot to be washed, a washing time period, per one cycle, and a washing time period (the number of washing cycles).

Figure 5:
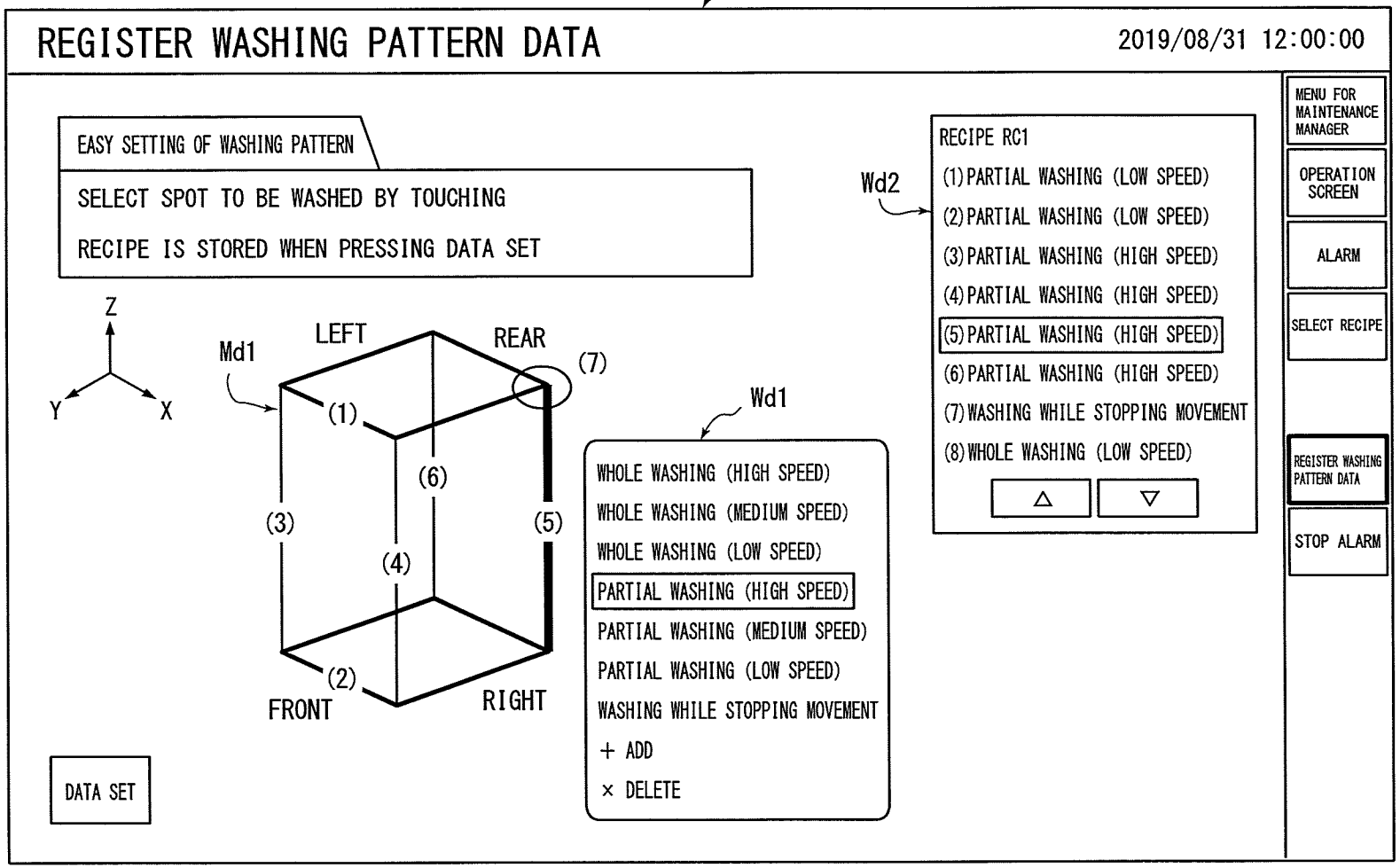
FIG. 5 is a diagram illustrating a display screen when a washing pattern of the vertical edge (5) is set using the display device of FIG. 3.

That is, as illustrated in FIG. 5, individual washing methods are sequentially input for respective spots (horizontal edges, vertical edges, and corners) to be washed indicated by (1) to (7) in the three-dimensional model Md1 having a square columnar shape. Since each of these spots is a heavily stained spot or a spot difficult to be washed, it is needed to be washed with the washing liquid W with emphasis.

Here, as examples of worker's operations performed by touching with a finger, when lightly touching a required spot on the input unit 7A (display screen) once, the worker can select the touch spot at a point (corner), when long-pressing the required spot, the worker can select a face, and furthermore, when dragging with a finger linearly while touching the required spot, the worker can select an edge (line). Note that the line that can be selected is not limited to an edge, and, for example, the worker may also select a waterline as a liquid level in the tank 2. In addition, a starting position of the washing may be able to be set to match the starting point of the dragged line. In addition, in the input unit 7A (display screen), a color of the selected spot can be changed or a line as the edge can be displayed in bold, if necessary. Moreover, the worker may be able to change a display angle of the three-dimensional model Md1 displayed on the input unit 7A by moving a finger while touching the three-dimensional model Md1 or pressing a rotation button displayed on the display screen, so as to easily select the spot to be washed. Note that a method of selecting such spots to be washed is an example, and is not limited thereto.

In the case of the three-dimensional model Md1 in FIG. 5, first, when being touched and dragged with a finger, a horizontal edge indicated by (1) is selected as a spot to be washed. Then, a window Wd1 is displayed on the input unit 7A, the worker selects (1) partial washing in the window Wd1, and selects a low speed in the partial washing, and further inputs required numeral values such as a washing time period, and the number of washing cycles. The worker checks the selected contents and the like, and then presses a data set button at a lower left portion of the input unit 7A. That is, the spot indicated by the horizontal edge (1) means a spot to be washed by the nozzle 3 at a low speed with emphasis. The contents are displayed as (1) in the top row in the contents display window Wd2 of a washing recipe RC1 at an upper right portion.

Next, when a horizontal edge at a lower side indicated by (2) is touched and dragged with a finger, a window Wd1 is displayed on the input unit 7A, the worker selects partial washing (low speed) in the window Wd1 in the same manner in the case of the horizontal edge of the above-described (1), and inputs required numeral values such as a washing time period, and the number of washing cycles. That is, the spot of the horizontal edge indicated by (2) means a spot to be washed at a low speed with emphasis. Then, the worker checks the selected contents and the like, and then presses the data set button at the lower left portion of the input unit 7A. Then, the contents are displayed as (2) in the second row in the contents display window Wd2 of a washing recipe RC1.

Next, when a vertical straight line portion at a front left end indicated by (3) is dragged, a window Wd1 is displayed, the worker selects partial washing (high speed) in the window Wd1, and inputs required numeral values such as a washing time period, and the number of washing cycles. That is, the vertical straight line portion indicated by (3) means a spot to be lightly washed while moving the nozzle at a high speed. Then, the worker checks the selected contents and the like, and then presses the data set button. Then, the contents are displayed as (3) in the third row in the contents display window Wd2 of a washing recipe RC1 at the upper right portion.

Hereinafter, regarding the vertical straight line spots indicated by (4), (5), and (6), the worker performs a selection operation and an input operation by similar operations to those of the spot indicated by the above-described (3). Then, the fixed contents are displayed in the fourth to sixth rows in the contents display window Wd2 of a washing recipe RC1 at the upper right portion.

Furthermore, when the worker touches a corner indicated by (7) lightly, a window Wd1 is displayed, the worker selects washing while stopping movement in the window Wd1, and inputs a stopping time period and the like. That is, the spot of the corner (7) means a spot to be washed with emphasis for a predetermined time period by stopping the movement of the nozzle 3. Then, the worker checks the contents, and then presses the data set button. Then, the fixed contents are displayed as (7) in the seventh row in the contents display window Wd2 of a washing recipe RC1.

Thereafter, when all the faces (four inner wall faces, a bottom face, and a top face) of the inner surface 2A of the tank 2 are washed at a low speed, the worker selects the whole washing (low speed) from the contents display window Wd2, and inputs required numeral values such as a washing time period, and the number of washing cycles. The contents are displayed as (8) in the eighth row in the contents display window Wd2 of a washing recipe RC1.

In this way, it is determined that the specific spots to be washed indicated by (1) to (7) in the three-dimensional model Md1 are washed in the washing methods displayed in the washing recipe RC1, and then the whole washing indicated by (8) is performed.

The washing recipe RC1 is thus determined, but in the operation processes described above, the contents including the washing methods selected and input in the input unit 7A (display screen) as described above are transmitted to the recognizing unit 7B each time.

The recognizing unit 7B is adapted to transmit the recipe RC1 having the contents input in the input unit 7A to the computing unit 6A of the control device 6. When receiving the recipe RC1 from the recognizing unit 7B, the computing unit 6A of the control device 6 computes and sets the parameters (rotation speeds, rotation amounts and the like) determining the operations of both of the servo motors 11 and 12, to implement the recipe RC1, and the set parameters are transmitted to the storage device 41 from the computing unit 6A, and are registered with and stored in the storage device 41. That is, the parameters for the recipe RC1 are set and stored in the storage device 41 (S5 in FIG. 4).

In the above-described manner, the worker operates the input unit 7A of the display device 7 by touching with a finger, whereby the parameters for both of the servo motors 11 and 12 for achieving the movement locus of the nozzle 3 when the tank 2 is washed are set, and the set parameters are stored.

Note that the description described above includes operations for setting the parameters for the tank 2 to be washed having a square columnar shape, but also regarding tanks assumed as objects to be washed having different sizes and shapes such as a cylindrical shape, a polygonal columnar shape, and the other shape, the worker can operate the above-described display device 7 to pre-resister the washing recipe corresponding to the tank to be washed with the storage device 41.

In this way, as illustrated in FIG. 1, when the tank 2 is actually washed by the washing device 1, the worker at site touches the input unit 7A of the display device 7 with a finger, selects the required washing recipe from the contents displayed in the input unit 7A, and then selects the spot displayed as the washing start. Then, the motor control unit 6B of the control device 6 controls the operations of both of the servo motors 11 and 12 so as to be able to implement the contents of the selected washing recipe. Thereby, the nozzle 3 is moved on the three-dimensional movement locus in the washing methods of the washing recipe, and therefore, the entire inner surface 2A of the tank 2 is washed with the washing liquid according to the washing recipe. According to the recipe RC1 illustrated in FIG. 5, the horizontal edge spots indicated by (1) and (2) are washed at a low speed with emphasis, and the corner spot indicated by (7) is washed with emphasis with the washing liquid ejected from the nozzle 3 that is temporarily stopped. The other spots in the inner surface is washed relatively easily while moving the nozzle 3 at a high speed. Therefore, the specific spots indicated by (1) to (7) are washed with emphasis in advance, and the entire inner surface 2A of the tank 2 indicated by (8) is washed, whereby the washing can be performed efficiently.

Note that when the worker at site desires to change the washing recipe RC1 before the tank 2 is washed by the washing device 1, the worker operates the input unit 7A of the display device 7 by touching with a finger to thereby be able to modify the contents of the washing recipe in the input unit 7A of the display device 7. In addition, the required washing operations may be added or deleted or the order of the washing operations may be changed. Also in such a case, the worker operates the input unit 7A of the display device 7 by touching with a finger, whereby the contents of the recipe can be changed easily.

In the present embodiment, the washing speeds are set at the low speed and the high speed, but the washing speed can be also set in detail by inputting the time period per one washing cycle in each process.

As described above, the washing device 1 of the present embodiment includes the display device 7, and the worker at site operates the three-dimensional model displayed on the input unit 7A by touching with a finger, whereby the parameters for both of the servo motors 11 and 12 can be set easily and the set parameters can be changed easily. In this way, the worker can set the parameters by operating the three-dimensional model, and therefore a workload of the worker at site can be significantly reduced as compared with the conventional technique.

When setting the parameters, the worker can change easily the washing methods for the specific washing spots to be washed with emphasis.

In the case where the type or shape of the tank 2 to be washed by the washing device 1 are changed, easy response to such changes is enabled by changing the washing recipe using the display device 7, whereby the working time period can be reduced.

Note that regarding the washing recipe already registered with the storage device 41, the washing operations of the nozzle 3 according to the recipe may be displayed on the input unit 7A (display screen) of the display device 7 as animations, so that the worker can check the operation contents.

As means for inputting the shape of the tank as an object to be washed, means for reading a shape from the CAD data or means for modeling a shape from a plurality of photographs may be used in addition to means for inputting the dimensions of the tank by the worker.

Furthermore, as described above, the worker touches the position to be washed with emphasis in the object to be washed on the input unit 7A of the display device 7, but besides, the input unit 7A may be configured so that the worker can select the required spots by operating with a mouse or the like or inputting worker's voice.

In addition, in the above-described embodiment, the tank 2 includes no top face, and the opening portion 2B of the tank 2 is closed by the lid body 5. However, the tank 2 provided with the opening portion 2B in a part of the top face or objects having the other shapes can be also washed by the washing device 1 of the present embodiment.

In addition, in the above-described embodiment, the height position of the nozzle 3 from the lid body 5 is fixed. However, a third servo motor for elevating and lowering the washing nozzle 3 may be provided, and the three-dimensional model Md1 having the washing nozzle may displayed on the display device 7, so that the parameters for the third servo motor can be set to change the height position of the nozzle 3 of the washing device 1 in response to elevating and lowering of the nozzle by an operator's touch of the nozzle in the three-dimensional model Md1 with a finger.

REFERENCE SIGNS LIST

1 washing device
2 tank (object to be washed)
3 nozzle
7 display device
15 inner tube (rotating member)
16 turning member
11 first servo motor
12 second servo motor
6 control device
S1 to S5 operation step

What is claimed is:

1. A washing device comprising: a rotating member that is provided in an axial rotatable manner; a turning member that is provided in a direction approximately perpendicular to the rotating member and provided in an axial rotatable manner; a washing liquid passage that is provided from the rotating member to the turning member; a nozzle that is provided to the turning member and ejects a washing liquid supplied through the washing liquid passage toward an object to be washed; a first servo motor that axially rotates the rotating member; a second servo motor that axially rotates the turning member; and a control device that controls operations of the first servo motor and the second servo motor, in which the nozzle ejects the washing liquid to the object to be washed, to wash the object to be washed, wherein the washing device comprises: display device that is capable of displaying a three-dimensional model corresponding to the object to be washed, in which when a spot to be washed in the three-dimensional model displayed on the display device is selected, the control device sets parameters for the first servo motor and the second servo motor so that the washing liquid is ejected from the nozzle to a spot to be washed in the object to be washed corresponding to the selected spot to be washed in the three-dimensional model.

2. The washing device according to claim 1, wherein the display device is capable of selecting the spot to be washed in the object to be washed and a washing method when the displayed three-dimensional model is touched with a hand of an operator.

3. The washing device according to claim 1, wherein the three-dimensional model of the object to be washed is displayed on the display device according to information on an input shape of the object to be washed.

4. An operation setting method for a washing device comprising: a rotating member that is provided in an axial rotatable manner; a turning member that is provided in a direction approximately perpendicular to the rotating member and provided in an axial rotatable manner; a washing liquid passage that is provided from the rotating member to the turning member; a nozzle that is provided to the turning member and ejects a washing liquid supplied through the washing liquid passage toward an object to be washed; a first servo motor that axially rotates the rotating member; a second servo motor that axially rotates the turning member; and a control device that controls operations of the first servo motor and the second servo motor, in which the nozzle ejects the washing liquid to the object to be washed, to wash the object to be washed, wherein the method comprises: an input step of inputting information on a shape of the object to be washed; a display step of displaying a three-dimensional model corresponding to the object to be washed, on the display device; a selection step of selecting a spot to be washed in the three-dimensional model displayed on the display device; and a setting step of setting parameters for the first servo motor and the second servo motor by the control device so that the nozzle ejects the washing liquid to a spot to be washed in the object to be washed corresponding to the selected spot to be washed.

* * * * *